US006551177B2

(12) United States Patent
Han

(10) Patent No.: US 6,551,177 B2
(45) Date of Patent: Apr. 22, 2003

(54) FORMING DEVICE FOR BEVELLING

(75) Inventor: Dong Han, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/946,060

(22) Filed: Sep. 4, 2001

(65) Prior Publication Data

US 2002/0195093 A1 Dec. 26, 2002

(30) Foreign Application Priority Data

Jun. 20, 2001 (TW) ..... 90210380 U

(51) Int. Cl.[7] ..... B24B 1/00

(52) U.S. Cl. ..... 451/56; 45/72; 125/11.01; 125/11.04; 125/11.06

(58) Field of Search ..... 125/11.01, 11.04, 125/11.06, 11.15; 451/72, 56

(56) References Cited

U.S. PATENT DOCUMENTS 4,262,649 A * 4/1981 Espinosa ..... 125/11.15
6,015,346 A 1/2000 Bennett
6,089,976 A 7/2000 Schneider et al.

* cited by examiner

*Primary Examiner*—Joseph J. Hail, III
*Assistant Examiner*—Alvin J. Grant
(74) *Attorney, Agent, or Firm*—WeiTe Chung

(57) ABSTRACT

A forming device (100) for bevelling includes a base (102), a rail (104), a workbench (106) and a bar (108). A pair of support arms (114) extends upwardly from the base. An axle (120) is received in pivot holes (118) defined in the support arms. One end of the rail is fixedly connected with the axle. The workbench rests on the rail, and is slidably moveable along the rail. A beveller (132) is fixedly installed in a top surface of the workbench. The bar is fixedly connected to an opposite end of the rail. The bar includes a large bar (134) abutting the support plate, and a coaxial small bar (136). The rail can be adjusted to allow the forming device to bevel at an angle of less than one degree, by placing one or a combination of standard gauges between the small bar and the base.

13 Claims, 3 Drawing Sheets

FORMING DEVICE FOR BEVELLING

BACKGROUND OF THE INVENTION

1. Field of the Invention

The present invention relates to forming devices for bevelling, and particularly to forming devices which can readily form bevels at small angles.

2. Prior Art

Products having gentle slopes are now universally used in modern industries. Such slopes are often formed by a grinding wheel of a grinder. The grinding wheel has a circumferential working surface, and the working surface is frequently beveled at an edge thereof. The bevel is generally formed by cutting the working surface with a forming device.

FIG. 4 show a conventional forming device 10 for bevelling. The forming device 10 comprises a base 12, a rail 14, a horizontal bar 16, and a workbench 18. A pair of support arms 22 extends upwardly from one side of the base 12. A pair of coaxial pivot holes 24 is respectively defined in the support arms 22. An axle 25 is pivotably received in the pivot holes 24. One end of the rail 14 is fixedly connected to the axle 25. The rail 14 is thus pivotable relative to the base 12. The bar 16 is fixed to an underside of an opposite end of the rail 14. A support plate 26 with a machined top surface is integrally formed on a top face of the base 12. The bar 16 abuts against the machined surface of the support plate 26. A beveller 32 is installed in a top surface of the workbench 18. In an initial position, the rail 14 is horizontal.

In operation, the forming device 10 is placed on a grinder (not shown). A gauge (not shown) is placed between the bar 16 and the support plate 26. The rail 14 thereby rests above the gauge at an angle, and the workbench 18 rests on the rail 14 at a corresponding angle. A grinding wheel (not shown) fixed on the grinder is located above the workbench 18, with the axis of the grinding wheel perpendicular to the axle 25. The grinding wheel is rotated at high speed. The workbench 18 is slidably moved along the rail 14 to contact and cut an edge of the grinding wheel. A circumferential surface with a bevel is thus formed on the grinding wheel.

Gauges having discrete thicknesses according to industry standards are widely used in this process. When a grinding wheel with a bevel of greater than one degree is needed, a single standard gauge or combination of different standard gauges can be used with the forming device 10. However, when a grinding wheel with a bevel of less than one degree is needed, there is no standard gauge available. A special thin gauge must be manufactured for use with the forming device 10. It is difficult and time-consuming to manufacture such thin gauge.

SUMMARY OF THE INVENTION

Accordingly, an object of the present invention is to provide a forming device which can form a bevel of less than one degree using standard gauges.

Another object of the present invention is to provide a forming device which can form two different bevels using a single standard gauge.

To achieve the above-mentioned objects, a forming device for bevelling in accordance with the present invention comprises a base, a rail, a workbench and a bar. The base has a support plate integrally formed on a top surface thereof. The support plate has a precision-machined surface. A pair of support arms extends upwardly from the base. A pair of coaxial pivot holes is respectively defined in the support arms, and an axle is received in the pivot holes. One end of the rail is fixedly connected with the axle. The rail is thereby pivotable relative to the base. The workbench rests on the rail, and is slidably moveable along the rail. A beveller is fixedly installed in a top surface of the workbench. The bar is fixedly connected to an underside of an end of the rail that is opposite to the end where the axle is connected. The bar comprises a large bar abutting the precision-machined surface, and a coaxial small bar. The rail can be adjusted to allow the forming device to bevel at an angle of less than one degree, by placing one or a combination of standard gauges between the small bar and the support plate.

Other objects, advantages and novel features of the present invention will be drawn from the following detailed embodiment of the present invention with attached drawings, in which:

DESCRIPTION OF THE PREFERRED EMBODIMENT

Figure 1:
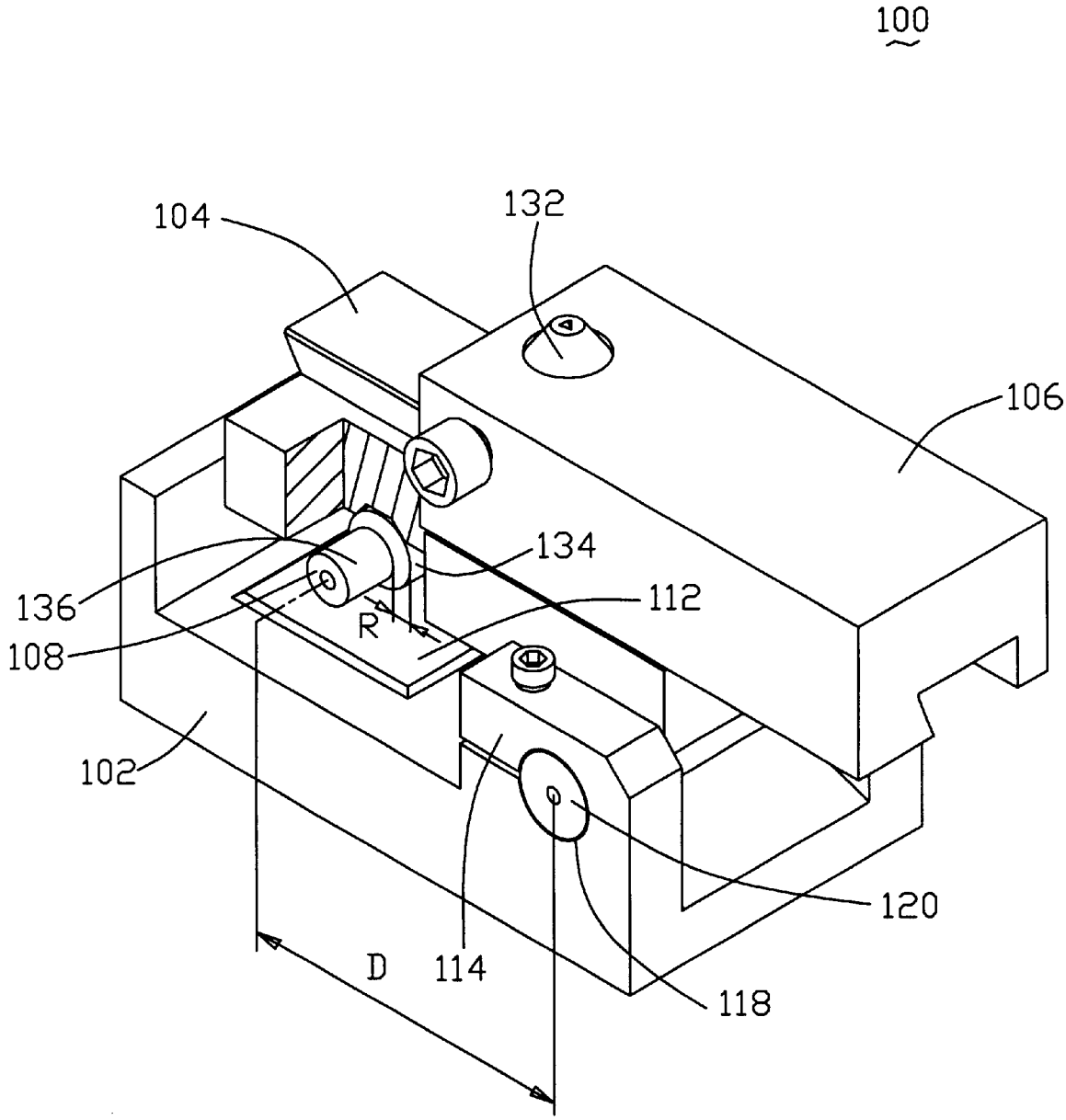
FIG. 1 is a perspective view of a forming device of the present invention in an initial state, partly cut away for clarity.

Referring to FIG. 1, a forming device 100 of the present invention comprises a base 102, a rail 104, a workbench 106, and a horizontal bar 108.

The base 102 comprises a support plate 112 integrally formed on a top surface thereof, near one end thereof The support plate 112 has a precision-machined top surface. A pair of spaced support arms 114 extends upwardly from an opposite end of the base 102. A pair of coaxial pivot holes 118 is respectively defined in the support arms 114. An axle 120 is pivotably received in the pivot holes 118. An end of the rail 104 is fixedly connected with the axle 120. The rail 104 is thereby pivotable about the pivot holes 118 relative to the base 102. The workbench 106 rests on the rail 104, and is slidably moveable along the rail 104. A beveller 132 is fixedly installed on a top surface of the workbench 106.

The bar 108 comprises a large bar 134, and a small bar 136 coaxial with the large bar 134. A difference between a radius of the large bar 134 and a radius of the small bar 136 is defined as R. A bolt (not shown) extends through the large bar 134 to engage with the rail 104, thereby fixedly connecting the bar 108 to an underside of an end of the rail 104 that is opposite to the end where the axle 120 is connected. The large bar 134 abuts the top surface of the support plate 112. In an initial position, the rail 104 is horizontal. An axis of the axle 120 is located at a same height above the top surface of the base 102 as is an axis of the bar 108. A distance between the axis of the axle 120 and the axis of the bar 108 is defined as D.

Figure 2:
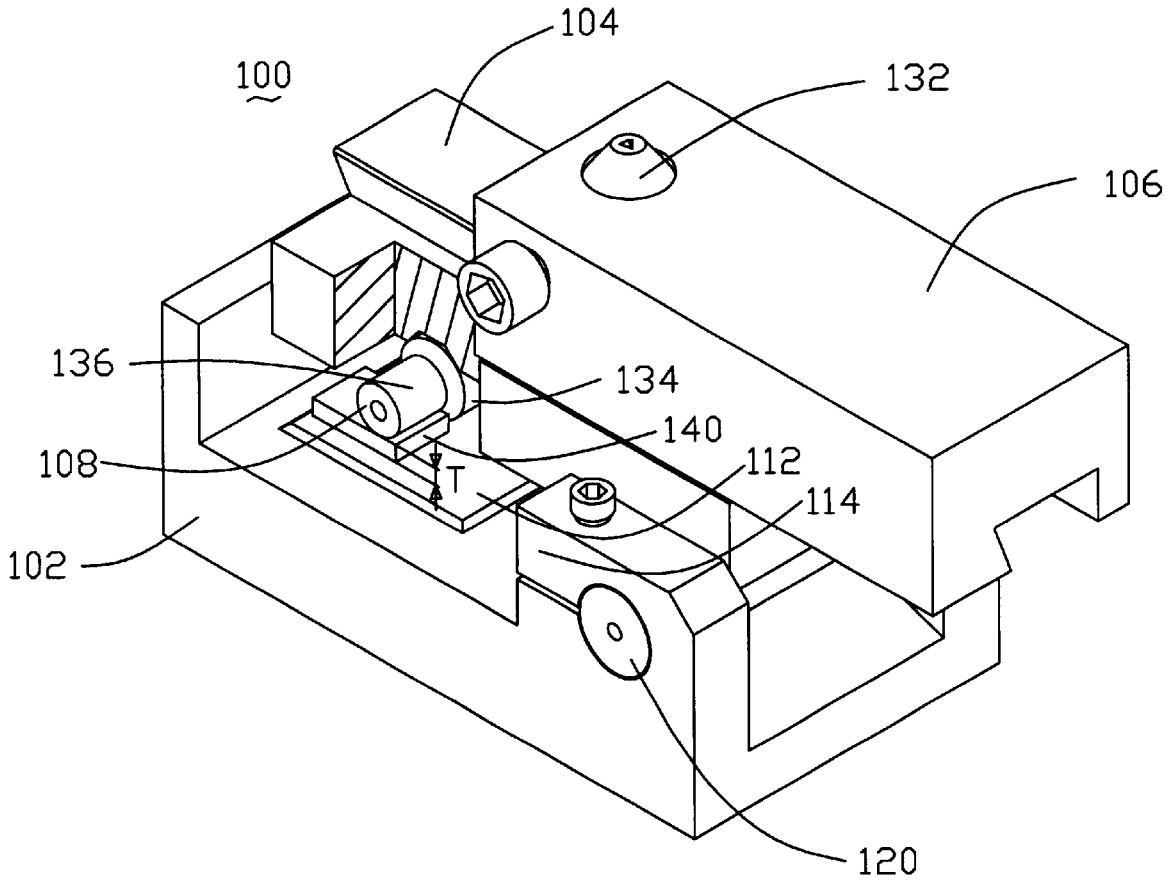
FIG. 2 is a perspective view of the forming device of FIG. 1, but in an operation state incorporating a gauge.

Referring also to FIG. 2, a gauge 140 has a thickness defined as T. T is greater than the above-mentioned difference R.

In use, the forming device 100 is placed on a grinder (not shown). The grinder has a grinding wheel (not shown)

located above and adjacent the workbench 106. An axis of the grinding wheel is perpendicular to the axle 120. A gauge 140 of desired thickness is selected, and is placed between the bar 108 and the support plate 112. The rail 104 thereby rests above the base 102 at an angle, defined as θ degrees (see FIG. 3). The workbench 106 resting on the rail 104 is accordingly sloped relative to the ba se 102 at an angle substantially equal to θ degrees. The grinding wheel is then rotated at high speed. The workbench 106 is moved back and forth along the rail 104. The beveller 132 contacts and cuts a circumferential surface of the grinding wheel. A bevel is thus formed on the circumferential surface of the grinding wheel. An angle of the bevel is equal to θ degrees.

Figure 3:
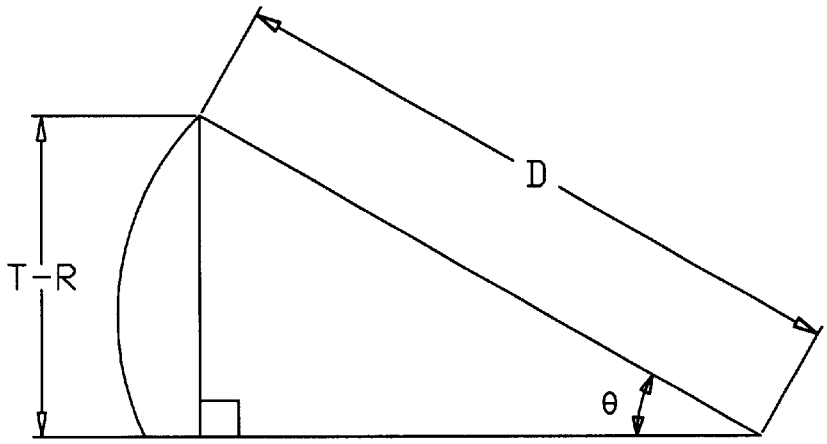
FIG. 3 is a sketch showing geometric relationships between items R, T, and D illustrated in FIGS. 1 and 2 and an item θ.
Figure 4:
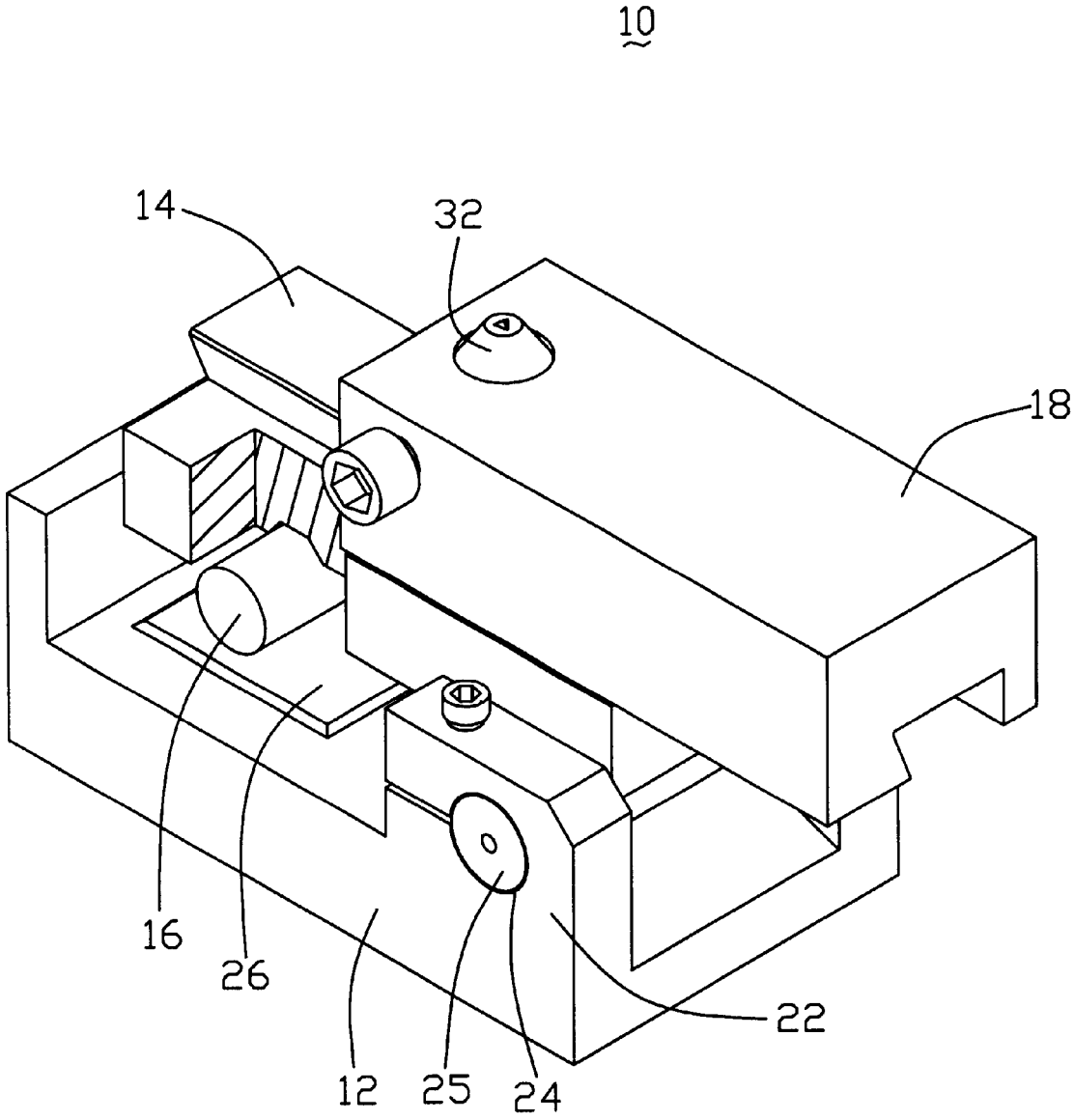
FIG. 4 (PRIOR ART)
FIG. 4 is a perspective view of a conventional forming device.

Referring particularly to FIG. 3, in using the forming device 100 of the present invention, the gauge 140 selected is typically one of a set of standard gauges. Each gauge in the set has a discrete thickness. The gauge 140 selected has a suitable thickness defined as T. When the gauge 140 is placed between the large bar 134 and the support plate 112, the thickness T is simply equal to the distance D multiplied by the sine of angle θ. That is, $T=D\times\sin(\theta)$. When the gauge 140 is placed between the small bar 134 and the support plate 112, the difference between the thickness T and the above-mentioned difference R is equal to the distance D multiplied by the sine of angle θ. That is, $T-R=D\times\sin(\theta)$. Accordingly, T is equal to the above-mentioned difference R plus the distance D multiplied by the sine of angle θ. That is, $T=R+D\times\sin(\theta)$. Thus, when the gauge 140 is placed between the large bar 134 and the support plate 112, angle θ is slightly greater than one degree. When the gauge 140 is placed between the small bar 136 and the support plate 112, angle θ is less than one degree. Angle θ becomes smaller when R is increased, provided that T remains constant. T becomes greater when R is increased, provided that angle θ remains constant. Accordingly the selected gauge 140, which is already commonly used and available in the industry, is readily used to obtain an angle θ of less than one degree.

Unlike with prior art forming devices, it is not necessary to manufacture a special thin gauge for the purpose of obtaining a bevel on a grinding wheel of less than one degree. The present invention enables a standard gauge 140 or combination of standard gauges 140 to be used to obtain a bevel on a grinding wheel of less than one degree. Furthermore, any one such selected gauge 140 is able to produce two different bevels, according to whether it is placed between the large bar 134 and the support plate 112 or placed between the small bar 136 and the support plate 112.

It is understood that the invention may be embodied in other forms without departing from the spirit thereof. Thus, the present example and embodiment is to be considered in all respects as illustrative and not restrictive, and the invention is not to be limited to the details given herein.

What is claimed is:

1. A forming device for shaping a grinding wheel, the forming device comprising:

a base having a support plate formed on a top surface of the base;

a rail, one end of the rail being pivotably connected with the base;

a workbench being located on the rail and slidably moveable along the rail;

a beveller adapted for cutting the grinding wheel, the beveller being fixedly installed in the workbench; and a bar fixedly connected with an underside of an opposite end of the rail, the bar comprising a large bar abutting the support plate, and a small bar, wherein the workbench can be adjusted to bevel at an angle of less than one degree by placing one or a combination of standard gauges between the small bar and the support plate.

2. The forming device as claimed in claim 1, wherein any one selected gauge is able to produce two different bevels, according to whether it is placed between the large bar and the support plate or placed between the small bar and the support plate.

3. The forming device as claimed in claim 1, wherein a pair of support arms extends upwardly from the base, a pair of coaxial pivot holes is respectively defined in the supporting arms, and an axle is pivotably received in the pivot holes.

4. The forming device as claimed in claim 3, wherein an axis of the axle is located at a same height above the top surface of the base as is an axis of the bar.

5. The forming device as claimed in claim 3, wherein the rail is fixedly connected with the axle.

6. The forming device as claimed in claim 1, wherein the beveller is fixedly installed in a top surface of the workbench.

7. The forming device as claimed in claim 1, wherein the support plate has a machined top surface.

8. The forming device as claimed in claim 1, wherein when the rail is sloped at an angle relative to the base, the workbench is sloped relative to the base at substantially the same angle.

9. A forming device for shaping a grinding wheel comprising:

a base having a top surface;

a rail, one end of the rail being pivotably connected with the base;

a workbench being located on the rail and slidably moveable along the rail;

a beveller adapted for cutting the grinding wheel, the beveller being fixedly installed in the workbench; and a bar fixedly connected with an underside of an opposite end of the rail, the bar comprising a large bar, and a small bar coaxial with the large bar, wherein any one selected standard gauge is able to produce two different bevels according to whether it is placed between the large bar and the base or placed between the small bar and the base.

10. The forming device as claimed in claim 9, wherein the workbench can be adjusted to bevel at an angle of less than one degree with respect to the base by placing one or a combination of standard gauges between the small bar and the base.

11. The forming device as claimed in claim 10, wherein the base has a support plate formed on a top surface thereof, and the bar is placed between said opposite end of the rail and the support plate.

12. A forming device for shaping a grinding wheel comprising:

a base having a top surface;

a rail, one end of the rail being pivotably connected with the base;

a workbench being located on the rail and slidably moveable along the rail;

a beveller adapted for cutting the grinding wheel, the beveller being fixedly installed in the workbench; and a bar fixedly connected with an underside of an opposite end of the rail, the bar forming thereof a step and associated upper and lower levels generally parallel to each other beside said step;

wherein any one selected standard gauge is able to result in two different bevels according to which levels said standard gauge is coupled to.

13. The forming device as claimed in claim 12, wherein the workbench can be adjusted to bevel at an angle of less than one degree with respect to the base by placing said one standard gauge at the upper level.

* * * * *